United States Patent [19]

Starek

[11] Patent Number: 4,621,934

[45] Date of Patent: Nov. 11, 1986

[54] INTEGRATED SOAP BAR AND BRUSH

[76] Inventor: Daniel A. Starek, 484 B Prospect Creek, Manchester, Mo. 63011

[21] Appl. No.: 762,272

[22] Filed: Aug. 5, 1985

[51] Int. Cl.[4] ..... A46B 11/00

[52] U.S. Cl. ..... 401/19; 401/18; 401/39; 401/88; 401/268

[58] Field of Search ..... 401/18, 19, 39, 88, 401/268

[56] References Cited

U.S. PATENT DOCUMENTS

| | | | |
|---|---|---|---|
| 28,422 | 5/1860 | Tusch . | |
| 2,131,500 | 9/1938 | Curtis, Jr. . | |
| 2,760,218 | 8/1956 | Gottfried . | |
| 2,946,074 | 7/1960 | Caldwell | 401/19 |
| 4,050,825 | 9/1977 | Stein . | |

FOREIGN PATENT DOCUMENTS

| | | | |
|---|---|---|---|
| 444378 | 5/1927 | Fed. Rep. of Germany | 401/19 |
| 1085155 | 7/1954 | France | 401/19 |
| 495501 | 6/1954 | Italy | 401/19 |
| 687816 | 2/1953 | United Kingdom | 401/39 |

*Primary Examiner*—Steven A. Bratlie

*Attorney, Agent, or Firm*—Glenn K. Robbins

[57] ABSTRACT

An integrated soap bar and brush. The brush constitutes one side of the integrated assembly while the bar of soap is supported on a top side of the brush to provide a reversible soap bar or brush. The soap bar is molded in situ around a specially constructed ribbed insert having a floor plate or base which can be readily affixed to the top side of the brush. The ribbed insert supports the soap bar during shrinkage to prevent removal until substantially used up. After such use-up, the insert may be used as a handle or it may be removed and the brush may be used alone.

12 Claims, 9 Drawing Figures

INTEGRATED SOAP BAR AND BRUSH

BACKGROUND OF THE INVENTION

In the hand or body washing operation a desirable feature is the provision of separate soaping and brushing. These operations may be repeated in sequence until the desired cleansing operation has been accomplished. Mechanics, agricultural and industrial workers encounter an environment in which cleansing is particularly difficult necessitating such alternate soaping and brushing in repetitive cycles.

In the past, various types of combination soap bar and brush assemblies have been employed. These have taken various forms such as brushes with prongs receiving replenishable bars of soap and the like and combination soap bars and brushes which may have a common surface to provide simultaneous soaping and brushing.

There has not been provided a reliable soap bar and brush structure which prevents the soap bar from sliding off the supporting brush structure. In such cases a substantial portion of the soap bar is lost which reduces the effectiveness of the unit.

Further, in such combination soap bar and brushes that have been available in the past there has not been provided an integrated soap bar and brush in which the brush may be employed as a simple brush after use-up of the soap bar. Such use of the brush with a separate bar of soap or other type of cleaner is desirable for maximum employment of the brush.

SUMMARY OF THE INVENTION

By means of this invention there has been provided an integrated soap bar and brush in which the use may be either as a bar of soap on one side or a brush on the other side. After the bar of soap has been exhausted the brush may be simply employed as a conventional brush with separate bars of soap or other types of cleaner.

A special feature of the invention resides in the provision of a uniquely constructed insert about which the bar of soap is molded in situ. The insert is provided with vertically and laterally extending ribs inside the bar of soap to firmly anchor the soap to the insert in a skeleton-like fashion. This construction firmly anchors the soap bar to the insert to keep it from sliding off during use-up. In this fashion the bar of soap can be retained for maximum economy until its last portion of life.

The ribbed insert has a unique T-bar rib which extends longitudinally through the bar of soap as well as cross-ribs. This rib construction embedded within the the bar of soap provides the firm stability and anchoring necessary for the bar retention.

For ready affixation to the brush the insert is provided with a base or floor plate. The bar of soap and insert are molded together and may be simply affixed to the top or back of a brush by attaching the base of the insert thereto.

The insert may be conveniently constructed of plastic which provides the necessary strength in the molded soap bar and slight flexibility to prevent injury to the user when the soap bar wears to expose the insert.

The molded soap bar and insert are used with a standard brush of polyethylene plastic or the like which has bristles supported by a body having a top side or back. The top side of the brush has an upstanding rim extending around the side which is used as a socket to receive the base or floor plate of the insert which closely nests therein. The affixation or securing of the base within the top of the brush may be simply effected by conventional adhesive or a friction fit as desired.

When the bar of soap has been used up the insert may be pried off the top of the brush or the insert may be left in place as a handle. The brush may then be simply used as a brush, per se, with separate bars of soap or other cleaners.

The above features are objects of this invention. Further objects will appear in the detailed description which follows and will be further apparent to those skilled in the art.

For the purpose of illustration of this invention, a preferred embodiment is shown in the accompanying drawing. It is to be understood that the drawing is for the purpose of example only and that the invention is not limited thereto.

IN THE DRAWING

DESCRIPTION OF THE INVENTION

Figure 1:
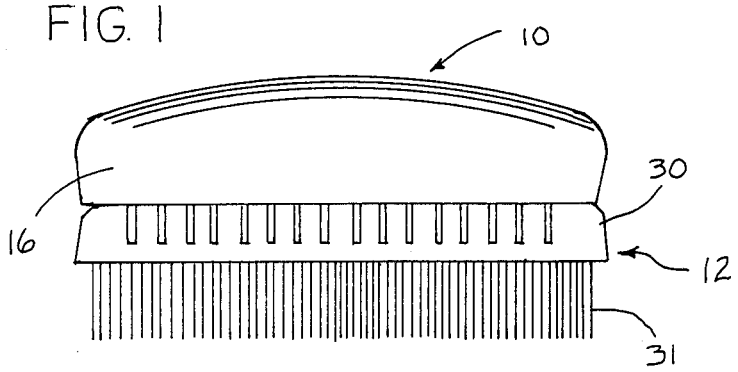
FIG. 1 is a view in front elevation of the integrated soap bar and brush.
Figure 2:
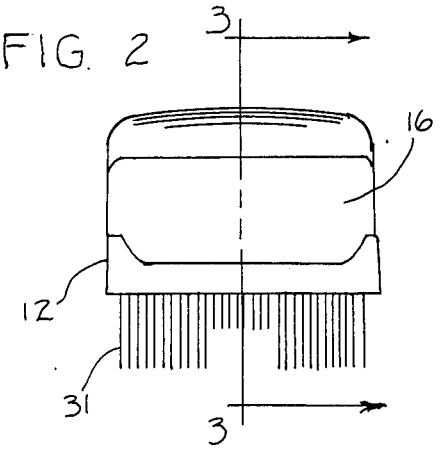
FIG. 2 is a left side view in elevation of the soap bar and brush.

The integrated soap bar and brush of this invention is generally indicated by the reference numeral 10 in FIGS. 1, 2, 3, 8 and 9. It is comprised of a brush 12 and an insert 14 attached to the top of the brush and supporting a soap bar 16 molded in situ over the insert.

The insert 14 provides a skeleton-like frame-work supporting the bar of soap and preventing it from being removed or slipping off the insert as it is used up. The insert may be conveniently constructed of plastic such as polyethylene or the like. The bar of soap is molded from conventional bar soap formulations and its composition forms no part of this invention, per se.

The brush likewise may be molded of conventional plastic such as polyethylene or the like. It is of a standard construction employed as a surgical scrub brush and elsewhere. It forms no part of this invention, per se, but when employed with the integrated soap bar provides a novel assembly useful both as a soap bar and scrub brush.

More particularly, the insert is comprised of a flat planiform base 18 supporting the skeleton-like framework comprised of a plurality of ribs over which the bar of soap is molded. A principal support rib in the form of a T-bar 20 extends upwardly from the base to a top portion of the soap bar. The T-bar is comprised of a trapezoidally-shaped vertical leg 22 extending longitudinally within the soap bar. It is connected to a header 24 extending transversely and horizontally within the bar. This construction firmly anchors the soap bar over the insert and through the trapezoidal shape continues to support the bar as it is used up without exposure until substantially worn.

A rib in the form of a transverse web 26 provides stability to the T-bar and provides further anchoring to the soap bar when it is worn down to a point lower than the header 24 of the T-bar. This web resists any longitudinal sliding of the soap bar near the end of the life of the bar as it is worn to a point near the base of the insert.

Transverse ribs 28 are further provided on the top side of the base of the insert. These ribs may be positioned between the web 26 and the opposite ends of the base to further resist any tendency of the last remaining portion of the soap bar to slide off the base.

The brush 12 as stated hereinabove is of standard construction. It is comprised of a body 30 supporting downwardly extending bristles 31. The body has a flat top side 32 supporting a peripheral rim 34. This construction provides a top in the form of a nest-like receptacle within which the molded bar of soap and insert are fitted.

Figure 3:
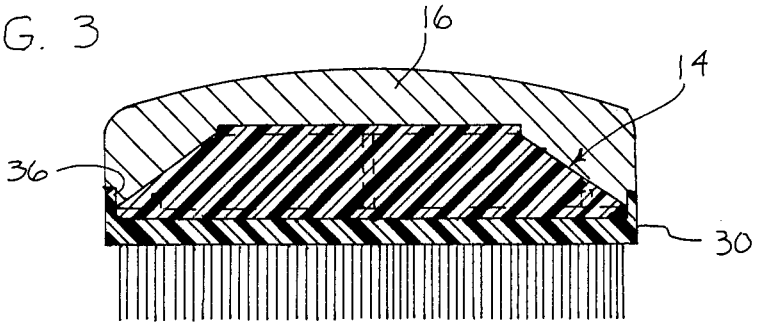
FIG. 3 is a view in section taken on line 3—3 of FIG. 2.
Figure 4:
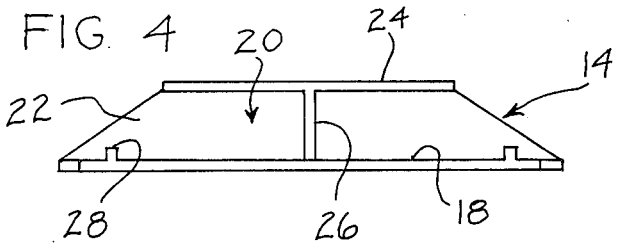
FIG. 4 is a view in front elevation of the soap bar insert.
Figure 5:
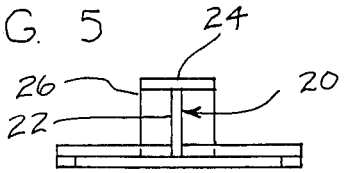
FIG. 5 is a left side view in elevation of the insert.
Figure 6:
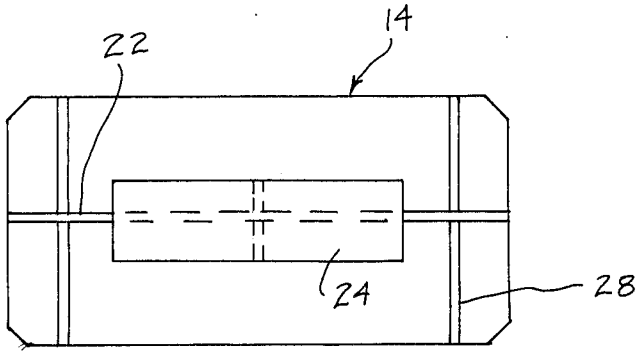
FIG. 6 is a top plan view of the insert.
Figure 7:
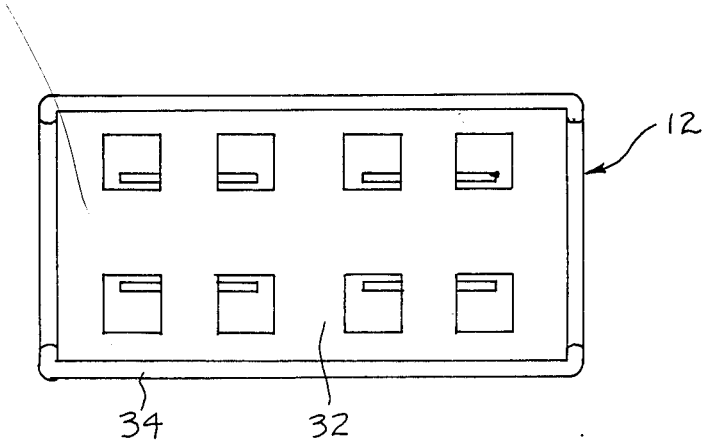
FIG. 7 is a top plan view of the brush.
Figure 8:
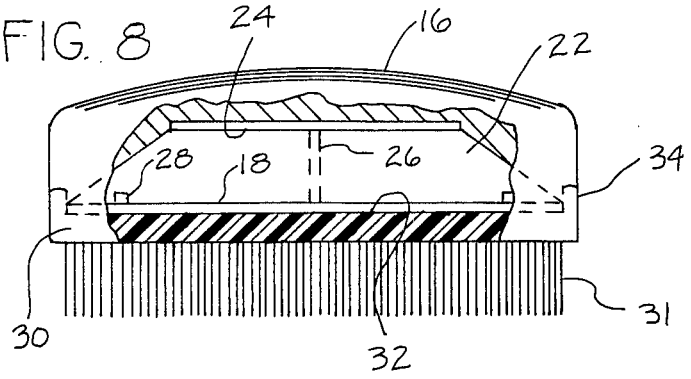
FIG. 8 is a view similar to FIG. 1 partially broken away to show the interior construction of the molded soap bar and insert.
Figure 9:
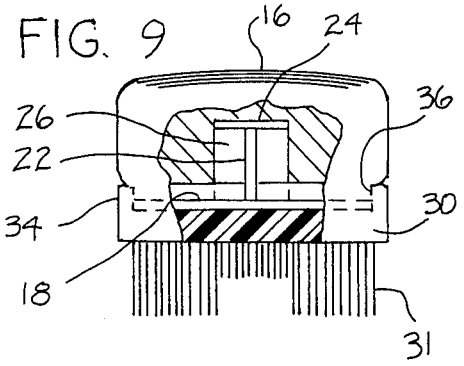
FIG. 9 is a view similar to FIG. 2 partially broken away to show the interior construction of the molded soap bar and insert.

As best shown in FIG. 3 the bar of soap and insert are closely fitted within the rim of the brush. The base of the insert nests closely within the rim and may be press-fitted therein or attached to the top side of the brush by a suitable and conventional adhesive. The slight resiliency of the plastic employed in the construction of the brush and the insert lends itself both to the press-fit and adhesion. The bar of soap may be molded to provide a cut-in shoulder 36 to fit over the top of the rim.

USE

The integrated soap bar and brush are simply employed. The soap bar side is employed to lather and clean while the opposite side is employed as a brush.

The stability provided by the insert over which the soap bar is molded in situ effectively prevents the soap bar from sliding off the insert. Further, the trapezoidal nature of the T-bar leg presents a frame-work which is not exposed until a substantial portion of the soap bar is used up. The transverse ribs 28 and web 26 serve to anchor the last remaining portions of the soap bar for maximum economy.

As the soap bar is used up and when it is exhausted the T-bar may be employed as a handle for the brush or the insert may be simply removed by prying it off the top of the brush. The brush may then be used as a brush alone with a separate bar of soap or other conventional cleaner. If desired, a fresh bar of soap with insert may be attached to the insert as will be well understood.

Various changes and modifications may be made within this invention as will be apparent to those skilled in the art. Such changes and modifications are within the scope and teaching of this invention as defined in the claims appended hereto.

What is claimed is:

1. An integrated soap bar and brush, said brush comprising a body having bristles depending therefrom, said soap bar being molded in situ over an insert embeded in said soap bar, said insert comprising a base extending substantially coextensive with a top surface of said brush body along a bottom portion of the soap bar, said base supporting said soap bar independently of said brush body, said base being affixed to said brush body and said insert further comprising rib members extending from said base through the soap in a three dimensional fashion to provide a longitudinal, transverse and vertical framework.

2. The integrated soap bar and brush of claim 1 in which the rib members comprise a T-shaped rib member connected to said base and extending longitudinally inside and upwardly in the soap bar interior.

3. The integrated soap bar and brush of claim 1 in which said brush body has a peripheral rim along the top and said insert base is closely nested therein.

4. The integrated soap bar and brush of claim 2 in which the rib members further comprise transverse ribs extending upwardly from said base into the interior of said soap bar.

5. The integrated soap bar and brush of claim 2 in which said T-shaped rib member is connected to a transverse rib extending across the insert base to provide stability for said T-shaped rib member.

6. The integrated soap bar and brush of claim 3 in which said brush is comprised of molded plastic and the brush body has a flat top, said insert being comprised of molded plastic, the base of said insert being planiform and fitting closely in registering relation within said peripheral rim.

7. The integrated soap bar and brush of claim 2 in which the rib members further comprise transverse ribs extending upwardly from said base into the interior of said soap bar and said T-shaped rib member is connected to a transverse rib extending across the insert base to provide stability for said T-shaped rib member.

8. The integrated soap bar and brush of claim 2 in which said brush body has a peripheral rim along the top and said insert base is closely nested therein.

9. The integrated soap bar and brush of claim 7 in which said brush body has a peripheral rim along the top and said insert base is closely nested therein and said brush is comprised of molded plastic and the brush body has a flat top, said insert being comprised of molded plastic, the base of said insert being planiform and fitting closely in registering relation within said peripheral rim.

10. The integrated soap bar and brush of claim 2 in which said T-shaped rib member is comprised of an upstanding leg member and a transversely extending header member.

11. The integrated soap bar and brush of claim 10 in which said upstanding leg member extends longitudinally along substantially the length of said base and tapers inwardly toward said header member at opposite ends to provide a substantially uniform separation of said T-shaped rib member as a bar of soap is used up.

12. The integrated soap bar and brush of claim 1 in which said insert is removable from said brush after the soap bar has been worn.

* * * * *